US007100999B2

(12) United States Patent
Stravitz

(10) Patent No.: US 7,100,999 B2
(45) Date of Patent: Sep. 5, 2006

(54) SYSTEM OF INTERLOCKING STORAGE AND DISPLAY MODULES CONNECTABLE IN A PLURALITY OF DIFFERENT CONFIGURATIONS

(76) Inventor: David M. Stravitz, 16 Park Ave., New York, NY (US) 10016

( * ) Notice: Subject to any disclaimer, the term of this patent is extended or adjusted under 35 U.S.C. 154(b) by 362 days.

(21) Appl. No.: 10/449,298

(22) Filed: May 29, 2003

(65) Prior Publication Data

US 2003/0222545 A1 Dec. 4, 2003

Related U.S. Application Data

(60) Provisional application No. 60/384,865, filed on May 30, 2002.

(51) Int. Cl.
*F16B 12/00* (2006.01)

(52) U.S. Cl. ..... 312/111; 312/108; 312/351; 312/330.1; 312/281; 312/249.8

(58) Field of Classification Search ..... 312/111, 312/108, 107, 351, 330.1, 280, 281, 249.8
See application file for complete search history.

(56) References Cited

U.S. PATENT DOCUMENTS 3,514,170 A * 5/1970 Shewchuk ..... 312/107
3,552,817 A * 1/1971 Marcolongo ..... 312/107
3,743,372 A * 7/1973 Ruggerone ..... 312/108
3,999,818 A * 12/1976 Schankler ..... 312/111
5,046,789 A 9/1991 Lee
5,454,634 A * 10/1995 Herbst et al. ..... 312/108
5,704,699 A * 1/1998 Pagelow et al. ..... 312/257.1
5,775,046 A * 7/1998 Fanger et al. ..... 52/590.1
6,003,924 A * 12/1999 Nicol et al. ..... 296/37.6
6,015,050 A 1/2000 Gilbertson
6,027,188 A * 2/2000 Nickens ..... 312/111
6,050,657 A 4/2000 Hiltzman
6,488,346 B1 * 12/2002 Chen ..... 312/263

* cited by examiner

*Primary Examiner*—Laurie K. Cranmer
(74) *Attorney, Agent, or Firm*—Frishauf, Holtz, Goodman & Chick, P.C.

(57) ABSTRACT

Modular storage and/or display system including substantially rectangular modules each including opposed first and second sides, opposed third and fourth sides perpendicular to the first and second sides and coupled thereto. A male connecting member is provided on an outer surface of each of the first and third sides and a female connecting member is provided on an outer surface of each of the second and fourth sides. The female connecting member has a structure complementary to the male connecting member. An additional male or female connecting member is provided on each of the first and second sides. By providing the same male and female connecting members on all sides of the modules, each module is connectable to any other module by coupling a connecting member on that module to an opposite connecting member on the other module.

26 Claims, 11 Drawing Sheets

70
10
14b
18
38
32
16
12a
36
38
18
12a
16
10
14a
18
16

10
20
12a
16
18
22
34
36
38
40
70
14a
14b
0.25 L1
L1
L2
0.5L2

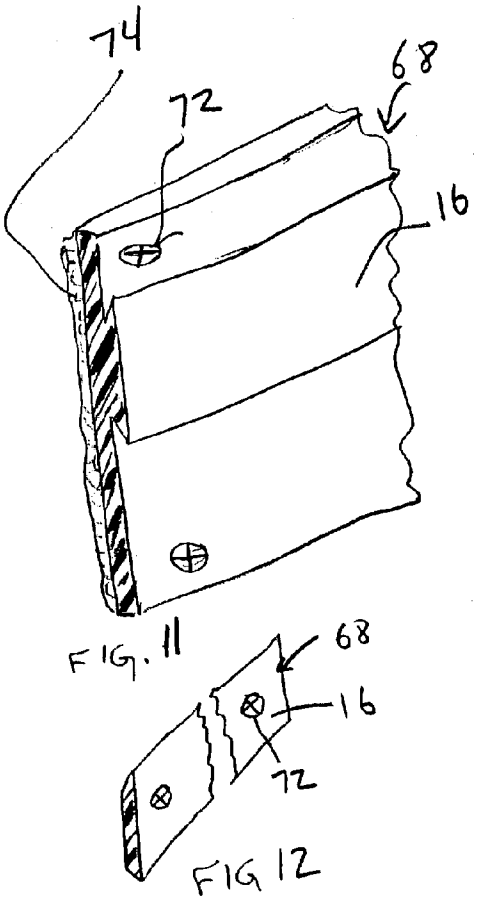
FIG. 11
FIG 12
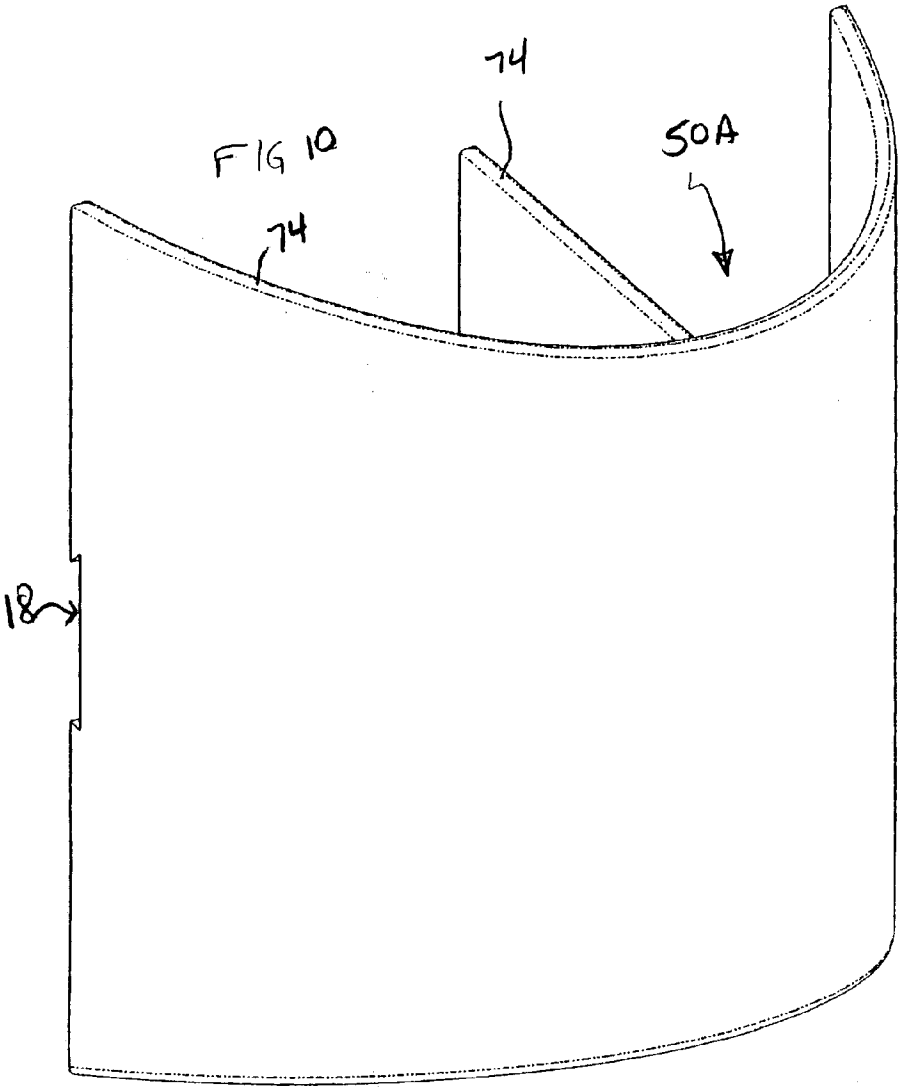
FIG 10

SYSTEM OF INTERLOCKING STORAGE AND DISPLAY MODULES CONNECTABLE IN A PLURALITY OF DIFFERENT CONFIGURATIONS

CROSS-REFERENCE TO RELATED APPLICATIONS

This application claims priority under 35 U.S.C. §119(e) of U.S. provisional application Ser. No. 60/384,865, filed May 30, 2002, the entire contents of which are incorporated herein by reference.

FIELD OF THE INVENTION

This invention relates generally to storage and display systems, and more particularly, to a modular storage and display system using interlocking modules that are connectable in a plurality of different configurations.

The present invention is particularly suitable for fabricating storage and display systems, using standard modules, for use in consumer applications, commercial applications and medical or institutional applications.

BACKGROUND OF THE INVENTION

Many devices and structures are known for storing and/or displaying various items, particularly in the ready-to-assemble furniture industry. Most storage structures, however, are designed to be assembled only in a single configuration. Some though are designed to be assembled in any one of a plurality of different configurations.

As to the latter type, U.S. Pat. No. 6,050,657 to Hiltzman shows a modular shelf system including a plurality of rectangular shelf modules which can be assembled in various configurations. Each shelf module has two male connecting members on one long side and two female connecting members on the other long side. Several shelf modules can be connected together along their long sides by inserting the male connecting members of one shelf module into the female connecting members of another shelf module. Further, in each module, one short side has a plurality of spaced apart apertures while the other short side has a plurality of spaced apart connectors adapted to be inserted into the apertures in the short side of another shelf module. Several shelf modules can be connected together along their short sides by inserting the plurality of connectors of one shelf module into the plurality of apertures of another shelf module.

A major disadvantage of the modular shelf system of Hiltzman is that the short sides and long sides do not include mating structures which can cooperate with one another. That is, it is not possible to connect the short side of one shelf module to the long side of another shelf module since the long sides have unique male and female connecting members whereas the short sides have different connecting members, i.e., the unique connectors and corresponding apertures. The inability to connect the long sides of the modules to the short sides of the modules resulting from the presence of two different cooperating connecting mechanisms, significantly limits the number of different configurations that can be formed using the modules of Hiltzman.

It is therefore desirable to provide a system of individual modules which can be assembled together in various configurations without limitations on the manner in which the modules can be connected together and specifically so that each side of every module can mate with more than one side of the other modules. It is also desirable to provide a modular system including a kit of various sized and shaped modules which can be assembled in a variety of different configurations so that the assembled structure can be used for storage and/or display purposes.

OBJECTS AND SUMMARY OF THE INVENTION

It is an object of the present invention to provide a new and improved modular storage and display system having a plurality of modules that are connectable together in virtually unlimited ways to form a plurality of different storage configurations.

It is another object of the present invention to provide a new and improved modular storage system having a plurality of modules which can be assembled in various configurations without significant limitations on the manner in which the modules can be connected together.

It is yet another object of the present invention to provide a new and improved modular storage system having a plurality of modules constructed with connecting members in a specific manner so that each side of every module can mate with more than one side of the other modules.

It is still another object of the present invention to provide a new and improved modular storage system having a plurality of various sized and shaped modules which can be assembled in a variety of different configurations so that the assembled structure can be used for storage and/or display purposes.

In order to achieve these objects and others, a modular storage and/or display system in accordance with the invention includes a plurality of substantially rectangular modules each including opposed first and second sides, opposed third and fourth sides perpendicular to the first and second sides and coupled thereto such that lateral edges of the third and fourth sides are coupled to lateral edges of the first and second sides to thereby provide the module with a rectangular shape. A male connecting member is provided on an outer surface of each of the first and third sides and a female connecting member is provided on an outer surface of each of the second and fourth sides. The female connecting member has a structure complementary to the male connecting member. An additional male or female connecting member is provided on each of the first and second sides.

By providing the same male and female connecting members on all sides of the modules, each module is connectable to any other module by coupling one of the male and female connecting members on that module to an opposite one of the male and female connecting members on the other module. As such, various configurations of the modules can be formed. Proper positioning of the connecting members can ensure flush surfaces when the modules are interlocked with each other.

By using modules having a basic rectangular shape, or a square shape, the invention can, without any metal fasteners or other types of separate fasteners whatsoever, become an extensive series of storage configurations from a simple module, to a broad range of storage solutions using a plurality of modules. It is noted that a rectangle is defined as a parallelogram all of whose interior angles are 90° and thus also encompasses a square.

In a preferred embodiment when rectangular modules are formed with one side being longer than another, the basic rectangular form allows various configurations of modules when multiple modules having the same dimensions are interlocked. Moreover, the presence of six (6) interlocking connecting members (two on each long side and one on each short side) enables various different orientations of the modules when interlocking them.

In one embodiment of a rectangular module, each long side has a male and female connecting member arranged such that the male and female connecting members follow one another around the periphery of the module in an alternating manner. In such an arrangement, the male connecting member on the short side is not adjacent to a male connecting member on either of the long side and the female connecting member on the short side is not adjacent to a female connecting members on either long side.

The positioning of the connecting members is important in the invention and in one embodiment, the male and female connecting members on the long sides are each centered at a location about 25% of the length of the long side from a respective lateral edge thereof. The male and female connecting members on the short side are centered between the lateral edges of the short sides.

The connecting members may be arranged parallel to one another and parallel to the lateral edges of the sides of the modules. A rear wall may be connected to rear edges of the sides of the module to partially enclose the space defined by the module. To enable attachment of the module to a wall or to another module, the rear wall can include one or more apertures designed to enable passage of a screw or nail therethrough.

Instead of having a male and a female connecting member on each long side, one long side can include two male connecting members and the other long side can include two female connecting members.

Various accessories, storage devices and display devices can be provided with one of the male and female connecting members and then engaged with the male and female connecting members of the module to thereby secure the accessories to the module. In this manner, enhanced modular systems can be created.

In another embodiment, each module includes a plurality of sides having opposed lateral edges and which are connected to one another at the lateral edges to thereby define an interior space. A male connecting member is provided on an outer surface of at least one of the sides and parallel to the lateral edges thereof while a female connecting member is provided on an outer surface of the same or a different side and parallel to the lateral edges thereof. The female connecting member has a structure complementary to the male connecting member. Each module is connectable to any other module by coupling one of the male and female connecting members on that module to an opposite one of the male and female connecting members on the other module. The same features of the modules described above can be used in this embodiment as well.

BRIEF DESCRIPTION OF THE DRAWINGS

The invention, together with further objects and advantages thereof, may best be understood by reference to the following description taken in conjunction with the accompanying drawings, wherein like reference numerals identify like elements.

FIG. 10 shows the pencil case accessory dismounted from the mounting strip.

FIG. 12 shows another type of mounting strip for accessories.

FIG. 14 is a front view of an assembly of four modules of the type shown in FIG. 13.

DETAILED DESCRIPTION OF THE INVENTION

Figure 1:
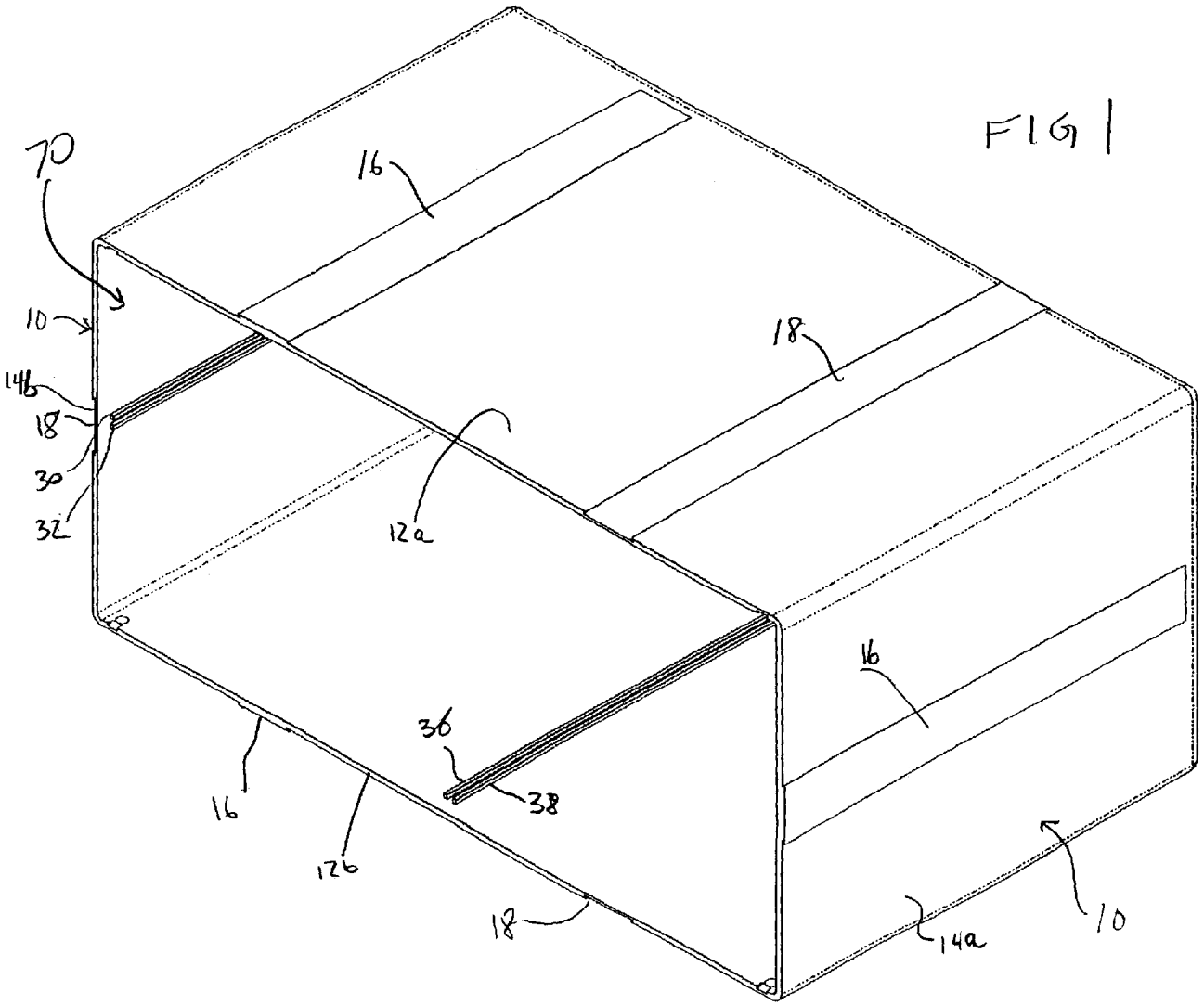
FIG. 1 is a perspective view of a first embodiment of a basic rectangular module according to the present invention.
Figure 2:
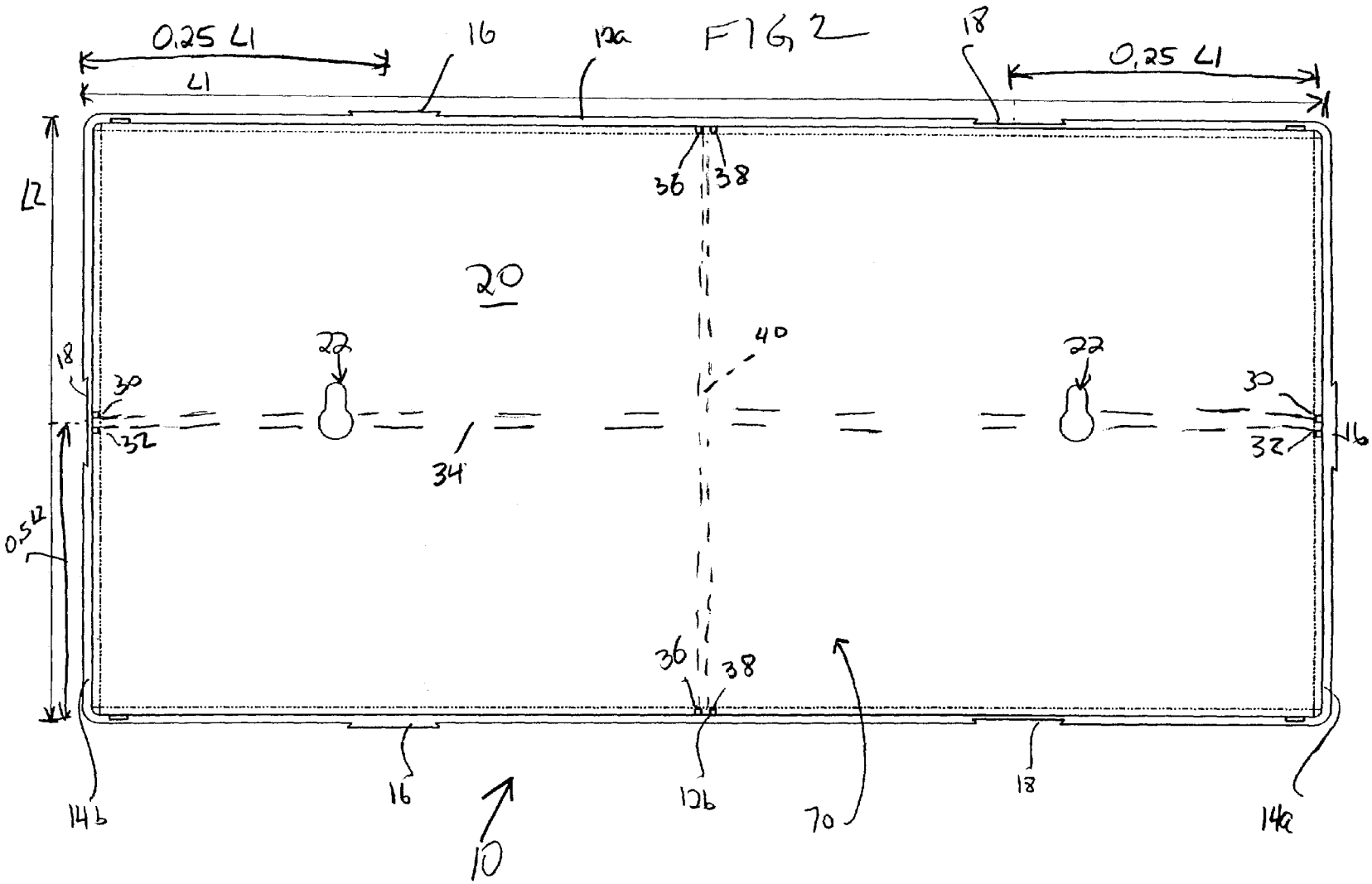
FIG. 2 is a front view of the module shown in FIG. 1.

Referring to the accompanying drawings wherein like reference numerals refer to the same or similar elements, FIGS. 1 and 2 show one embodiment of a basic module 10 in accordance with the invention which can be used as a building block of any number of different storage units.

Module 10 has two opposed long walls or sides 12*a*, 12*b* and two opposed short walls or sides 14*a*, 14*b* which are perpendicular to the long sides 12*a*, 12*b* to thereby provide the module with a rectangular shape. Although the term "sides" is used herein to designate the parts of the module 10, the sides could also be considered as walls or panels. As shown in, for example, FIG. 1, the sides 12*a*, 12*b*, 14*a*, 14*b* each have substantially planar outer surface.

Lone sides 12*a*, 12*b* each include a front edge, an opposed parallel rear edge, and opposed, parallel lateral edges defining a length L1 (see FIG. 2) therebetween. Short sides 14*a*, 14*b* each include a front edge facing the same direction as the front edge of the long sides 12*a*, 12*b*, an opposed parallel rear edge facing the same direction as the rear edge of the long sides 12*a*, 12*b*, and opposed, parallel lateral edges defining a length L2 (see FIG. 2) therebetween. The lateral edges of the short sides 14*a*, 14*b* are coupled to or integral with the lateral edges of the long sides 12*a*, 12*b*.

Module 10 also includes a plurality of cooperating male connecting members 16 and female connecting members 18 placed on the long and short sides 12*a*, 12*b*, 14*a*, 14*b* in a specific manner to enable the module 10 to form a building block of a larger storage and/or display structure.

Specifically, in the embodiments of FIGS. 1 and 2, each short side 14*a*, 14*b* includes a single connecting member, short side 14*a* including a male connecting member 16 and short side 14*b* including a female connecting member 18. On the short sides 14*a*, 14*b*, the connecting members 16, 18 are centered between the lateral edges of the respective short side 14*a*, 14*b* (i.e., centered at a distance 0.5×L2 from each lateral edge) and oriented parallel to the lateral edges of the short sides 14*a*, 14*b* so that they extend substantially from the front edge to the rear edge of the sides 14*a*, 14*b*. Thus, portions of the planar outer surface of the side 14*a* are present between the single male connecting member 16 and the lateral edges of side 14*a* and portions of the planar outer surface of the side 14*b* are present between the single female connecting member 18 and the lateral edges of side 14*b* (see FIGS. 1 and 2).

On each long side 12*a*, 12*b* of the module 10, two connecting members 16, 18 are provided. In the embodiment shown in FIGS. 1 and 2, each long side 12*a*, 12*b* includes one male connecting member 16 and one female connecting member 18. The connecting members 15, 18 are placed on the long sides 12*a*, 12*b* of the module 10 such that a male connecting member 16 on each long side 12*a*, 12*b* is positioned directly opposite a male connecting member 16 on the other long side 12*a*, 12*b* and a female connecting member 18 on one long side 12*a*, 12*b* is positioned directly opposite a female connecting member 18 on the other long side 12*a*, 12*b*. Moreover, the connecting members 16, 18 on each long side 12*a*, 12*b* are spaced apart from one another by a portion of the planar outer surface of the respective side 12*a*, 12*b* (see FIGS. 1 and 2).

The positioning of the connecting members 16, 18 on the long sides 12*a*, 12*b* is important to the invention to enable coupling of the long side 12*a*, 12*b* of one module 10 to the short side 14*a*, 14*b* of other identical modules 10. On the long sides 12*a*, 12*b*, the connecting members 16, 18 are therefore centered at a location which is approximately a distance of about 25% of the length L1 of the long sides 12*a*, 12*b* from each lateral edge (see FIG. 2). The connecting members 16, 18 on each long side 12*a*, 12*b* are also oriented parallel to the lateral edges of the respective long side 12*a*, 12*b* so that they extend substantially from the front edge to the rear edge of the sides 12*a*, 12*b* and thus all of the connecting members 16, 18 on the module 10 are parallel to one another.

Figures 3, 4:
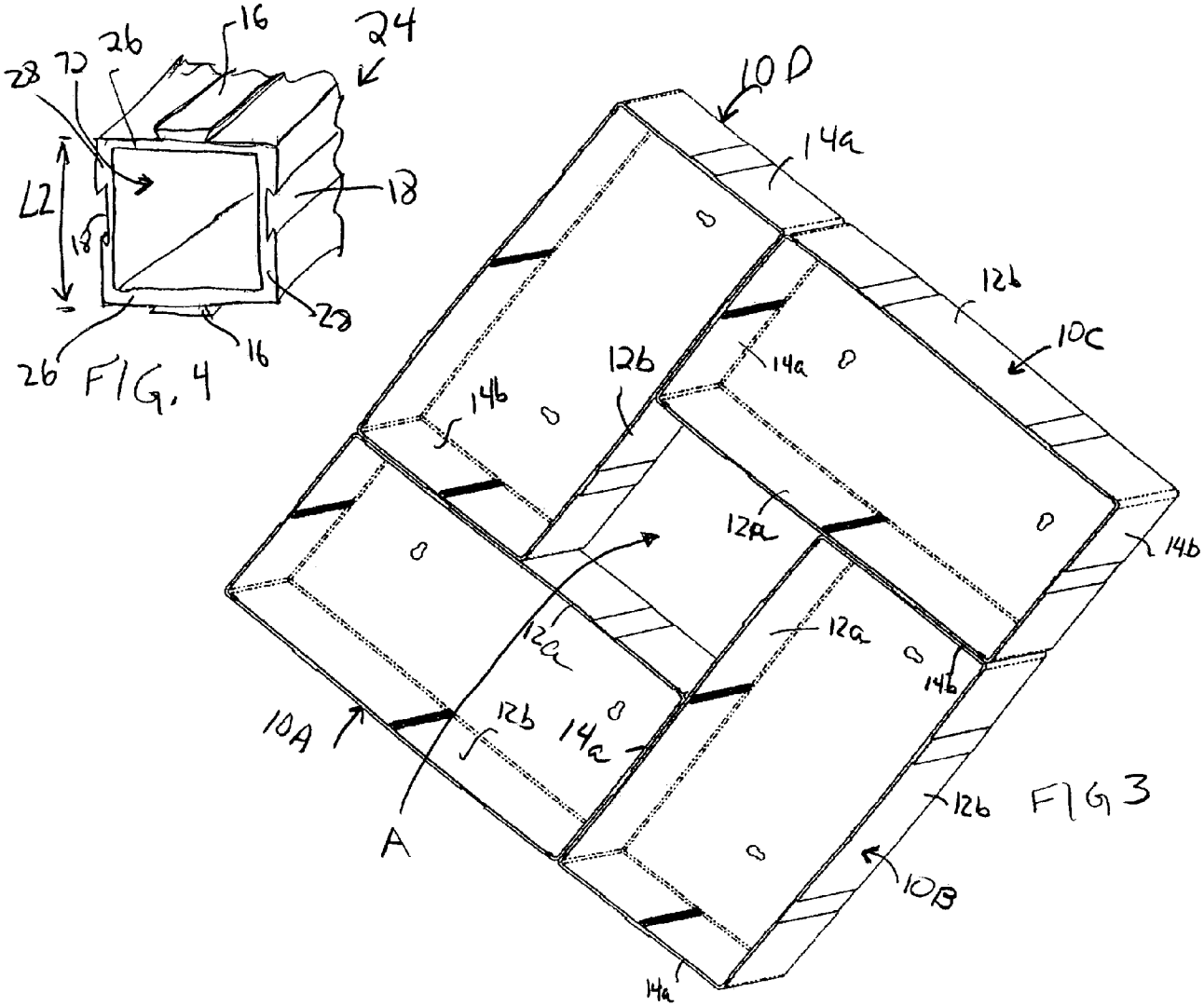
FIG. 3 shows four rectangular modules of the present invention, interconnected to form a storage and display system.
FIG. 4 shows a partial view of a square module insertable in the center of the system shown in FIG. 3.

In view of the construction and positioning of the connecting members 16, 18 on the long and short sides 12*a*, 12*b*, 14*a*, 14*b*, interlocking of the modules 10 by engagement of the width (short side) of one module 10 to the length (long side) of another module is possible and will provide a flush outer wall (see FIG. 3). For example, the short side 14*a* of one module 10 can be engaged with either of the long sides 12*a*, 12*b* of another module 10 and also with the short side 14*b* of another module 10. Thus, each short side 14*a*, 14*b* can mate with three different sides of another module 10 which greatly expands the possibilities of constructing a modular system in accordance with the invention.

As to the placement of the specific male or female connecting members 16, 18 on the long sides 14*a*, 14*b*, proceeding clockwise, or counter clockwise, starting anywhere on the six connecting members 16, 18 that are on the perimeter of the module 10, a male connecting member 16 follows a female connecting member 18 going around the periphery of the module 10 (see FIG. 2). That is, a male connecting member 16 follows a female connecting member 18 and a female connecting member 18 follows a male connecting member 16. As used herein, a connecting member which follows another is that connecting member which is immediately after the first connecting member on the same module when proceeding around the module in either a clockwise or counterclockwise manner. The following connecting member may either be on the same side or an adjoining side.

The widths of the connecting members 16, 18 are not critical to the invention. However, depending on the dimension of the module 10, the width becomes important from a strength point of view as the connecting members 16, 18 must be sufficiently strong to enable a strong interlocking fit between adjacent modules 10. Also, regardless of the width of the connecting members 16, 18, the center line of the connecting members should be at the locations described above relative to the lateral edges of the sides 12*a*, 12*b*, 14*a*, 14*b*.

The front edges of long and short sides 12*a*, 12*b*, 14*a*, 14*b* define an opening 70 enabling access to the space in the interior of the module 10 defined by the sides 12*a*, 12*b*, 14*a*, 14*b*. A rear wall or panel 20 is attached or integrally connected to the rear edges of the long and short sides 12*a*, 12*b*, 14*a*, 14*b* as shown in FIG. 2.

To enable modules 10 to be mounted on a wall or other planar surface, the rear wall 20 includes an attachment mechanism 22 which enables attachment of the module 10 to the wall. The attachment mechanism 22 may comprise openings, such as keyhole openings. In addition, to enable modules 10 to be connected to one another back-to-back, the attachment mechanism 22 may comprise complementary male and female parts, dovetail connectors, adhesive hook and loop fasteners and other types of fasteners.

The length of the module 10 is the same as the length of the long sides 12*a*, 12*b* (L1) and the width of the module is the same as the length of the short sides 14*a*, 14*b* (L2). To enable use of a plurality of modules 10 in various configurations, L1 should equal a whole number multiple of L2. In the embodiment shown in FIG. 1, L1 is twice L2. However, it is conceivable that L1 may be, for example, 3 times L2 in which case, a more elongated module would be formed.

The main difference between different length modules would be the number of connecting members 16, 18 thereon. Generally, the long side of a module should have a length and number of connecting members which is the same number multiple of the length and connecting member(s) on the short side. In the illustrated embodiment, the length of the long sides 12*a*, 12*b* are twice that of the short sides 14*a*, 14*b* and thus there are twice as many connecting members 16, 18 on the long sides 12*a*, 12*b* as are on the short sides 14*a*, 14*b*. If the long sides were three times as long as the short sides and the short sides have single connecting members, then there would ideally be three connecting members on the long sides. A lesser number of connecting members could be provided on the long sides but would detract from the maximum use of the modules.

Using a module 10 having the construction described above, a plurality of the modules can be stacked (one over another) and interlocking modules can be connected at 90 degrees to stacked modules. This allows for numerous vertical and horizontal combinations and permutations of modules in accordance with the invention. One such example is shown in FIG. 3 where four rectangular modules 10A, 10B, 10C, 10D are connected to each other to form a perfect square (the length and height of the stack are both the length of one module and the width of another module (L1+L2)). Another arrangement might be four rectangular modules with two stacked on each other in one direction (horizontally, for example) and two stacked at 90 degrees (vertically).

The assembly of modules shown in FIG. 3 may be assembled by engaging the male connecting member 16 on the short side 14*a* of one module 10A to a female connecting member 18 on the long side 12*a* of another module 10B, engaging the male connecting member 16 on the long side 12*a* of another module 10C to the female connecting member 18 on the short side 14*b* of the module 10B and engaging the male connecting member 16 on the long side 12*a* of module 10A to the female connecting member 18 on the short side 14*b* of another module 10D while a female connecting member 18 on the long side 12*b* of module 10D is engaged with the male connecting member 16 on the short side 14*a* of module 10C.

Since the length of the module 10 (L1) is about twice the width (L2) for each module 10, it is also possible to form a square module 24 (shown in FIG. 4) having an equal length and width for use as a center module to fit into space A in the modular system shown in FIG. 3. In the square module 24, the sides 24 all have the same length which is equivalent to the width of the rectangular module 10 (the length L2 of the short sides 14*a*, 14*b*) so as to enable the square module 24 to interlock with rectangular modules 10.

As shown in FIG. 4, the square module 24 includes four connecting members 16, 18 around its perimeter with male connecting members 16 on opposite sides 26 and female connecting members 18 on opposite sides 28. The sides 26, 28 each have a front edge which together define an opening 72 enabling access into the interior of the module 24 and each have an opposed rear edge to which a rear wall may be integrally coupled (not shown).

Square modules 24 can now be interlocked with rectangular modules in numerous configurations. It is possible to add square modules 24 to the ends of the widths of rectangular modules 10 adding an additional 50% in length to the rectangular module 10.

As shown in FIGS. 1 and 2, support members such as elongated projections 30, 32, 36, 38 can be provided on various inner surfaces of the sides 12*a*, 12*b*, 14*a*, 14*b* of the module 10 so as to provide support members for a shelf or the like. As shown in FIG. 2, a shelf or partition 34 (shown in broken lines) may be removably arranged between the elongated projections 30, 32 on the inner surface of opposite sides 14*a*, 14*b*, to be fully supported thereby. Similarly, elongated projections 36, 38 could be provided on the inner surface of sides 12*a*, 12*b* so as to provide an engagement device for a vertical wall or partition 40 (shown in broken lines in FIG. 2) which is removably arranged between elongated projections 36, 38. Thus, projections 30, 32, 36, 38 can accept a slidable partition or shelf member therebetween to serve as either a shelf when horizontal or a wall when vertical depending on the orientation of the module 10. When a horizontal and vertical partition are used together, they are slotted at least partly through the widths thereof to interlock with each other where they cross each other.

Instead of elongated projections 30, 32, 36, 38, other forms of projections or support members (or even recesses if the walls are sufficiently thick) can also be used to support and place horizontal shelves or vertical partition walls. For example, a plurality of discrete, spaced-apart projections could be used instead of each elongated projection. The projections 30, 32, 36, 38 could also be used to guide drawers.

Figure 5:
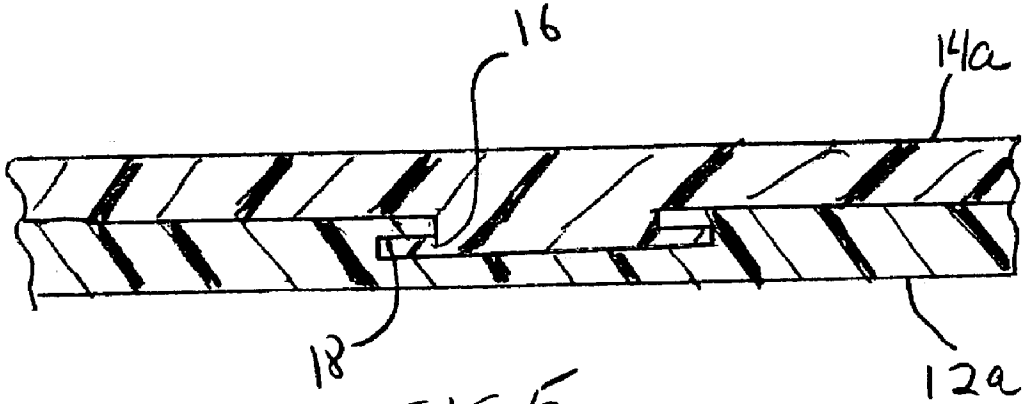
FIG. 5 shows another type of interlocking member which can be used in place of the dovetail members present in the embodiments shown in FIGS. 1–4.
Figure 6:
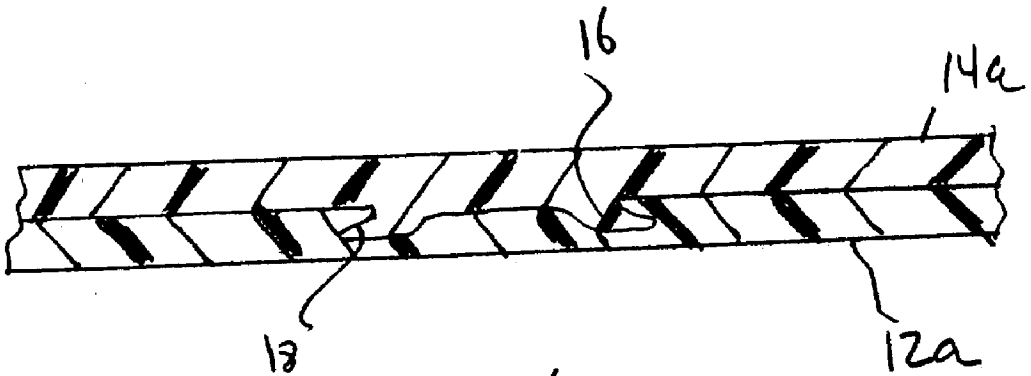
FIG. 6 shows another type of interlocking member which can be used in place of the dovetail members.

As shown in FIG. 2, the connecting members 16, 18 are in the form of dovetails. However, this invention can work with numerous other interlocking profiles, as well (see FIGS. 5 and 6). The interlocking profiles should have a male member which is capable of interlocking into and being trapped by a female member. Also, although the connecting members 16, 18 are shown integral with the sides 12*a*, 12*b*, 14*a*, 14*b* of the module 10, they can be formed separate from the module 10 and attached thereto.

The modules 10 may have different depths so that, for example, lower modules would have a larger depth than upper modules. If the modules are placed with the rear walls flush with one another, a ledge would be formed in front of the upper modules and would be the upper surface of the upper long side of the lower modules.

Using modules 10, 24 described above and other modules which can be created following the general constructions described above, various modular systems can be constructed. The possibilities of such constructions are virtually unlimited. For example, in view of the ability to couple the modules 10 together back-to-back, i.e., via the rear walls 20, carts and desks can be formed. Also, numerous dovetail mating accessories can be constructed for storage in a myriad of applications, including but not limited to desk accessories, kitchen storage compartments, doors, drawers, shelves, book ends, file organizers, medical caddy's, home care tables and the like. These accessories can substantially be interlocked against and into the connecting members 16, 18 on the modules 10 so that the accessories are secured to the modules 10.

Moreover, the accessories do not require a backing or flange since they essentially use the surface of the module 10 on which they are mounted as the back. This offers a substantial cost savings from a manufacturing point of view since less plastic is used and the cost for tool construction is less since the absence of a backing requires a significantly smaller, less sophisticated tool. Tools with backings can run into the hundreds of thousands of dollars.

Figure 7:
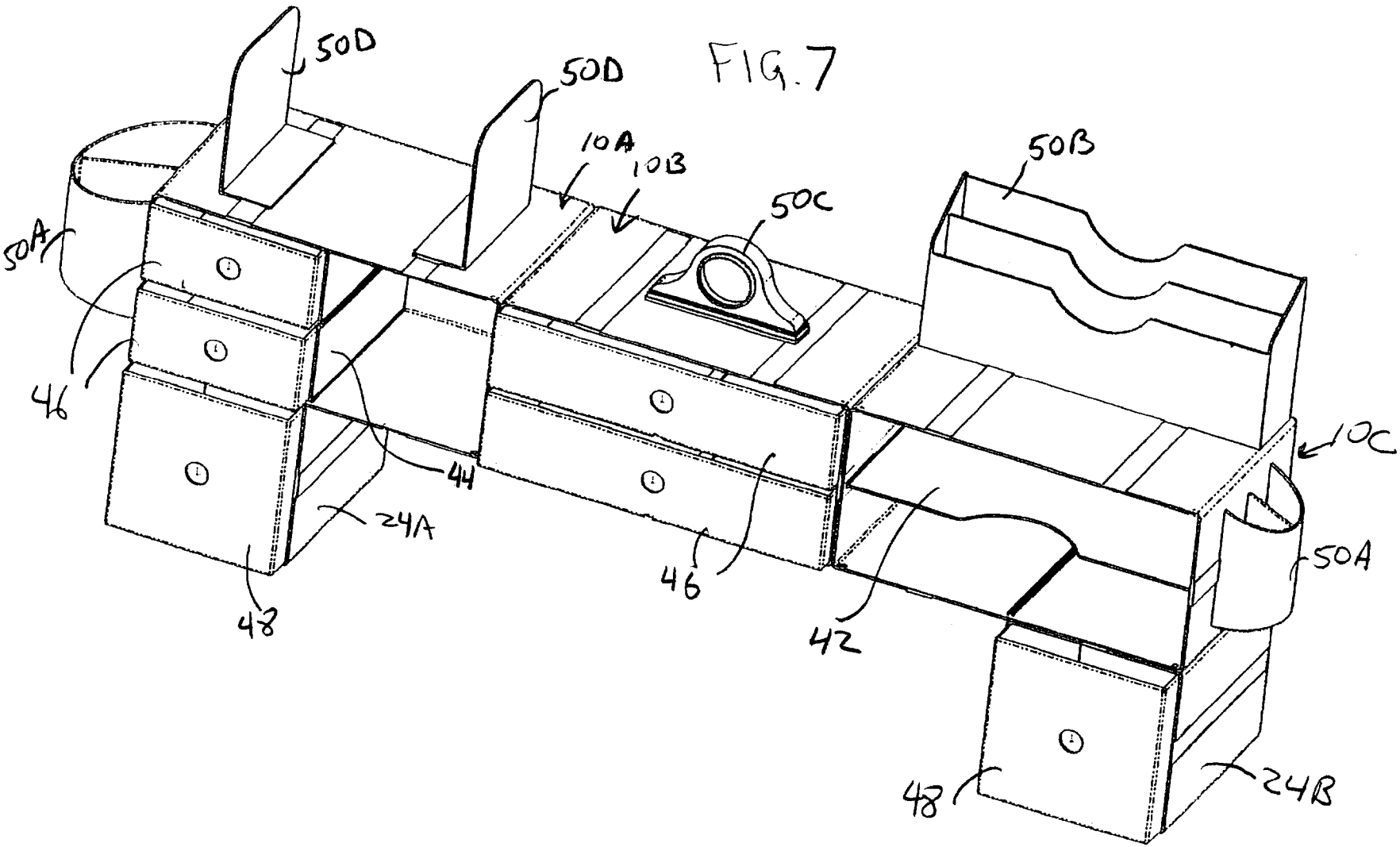
FIG. 7 is a perspective view of an assembly of modules in accordance with the present invention, with various accessories shown connected thereto.

FIG. 7 shows a construction of several modules 10 wherein a horizontal shelf 42 (similar to partition 34 in FIG. 2) is provided in one module 10A, a vertical divider 44 (similar to partition 40 in FIG. 2) is provided in module 10C and drawers 46 are provided in modules 10B and 10C. Drawers 48 are also provided in square modules 24A and 24B. The shelf 42 and divider 44 may be supported by the elongated projections 30, 32, 36, 38 described above (see FIGS. 1 and 2) and the drawers 46, 48 may also be slidably supported by the elongated projections 30, 32, 36, 38 or by other support and guide mechanisms, or by sliding on a lower surface of a module (as are drawers 48 and the lower one of the drawers 46).

Accessories 50 are mounted to the modules 10A, 10B, 10C and may include pencil holders 50A (which are backless, and which back-up on surfaces of the modules to which they are mounted), a file holder 50B, a clock 50C and book-ends 50D. Since the accessories 50 are provided with either a male or female connecting member 16, 18, they can slide into the connecting members 16, 18 on the modules 10. The clock 50C is not shown engaged with a connecting member 16, 18, but it may be so connected by having a mating connecting member on the lower surface thereof.

Figure 8:
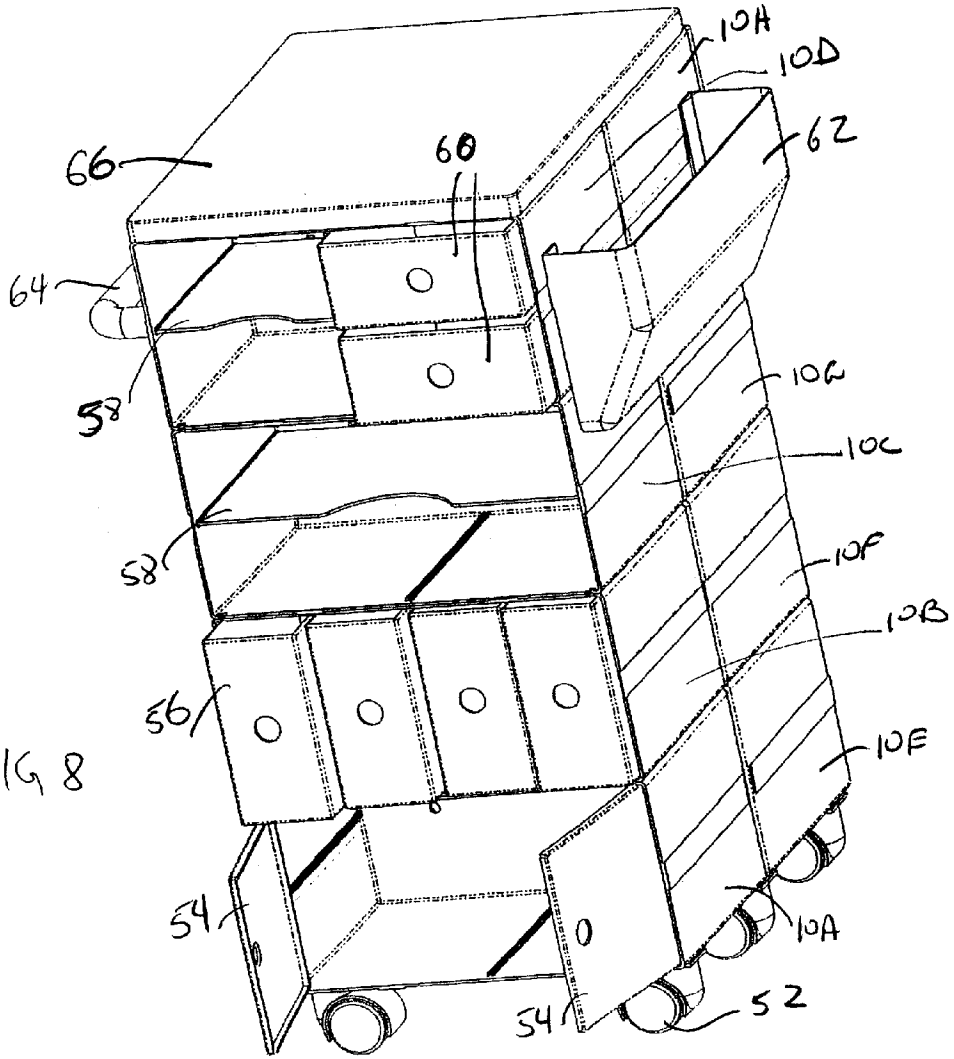
FIG. 8 is a perspective view of a cart formed from modules in accordance with the invention with accessories on the sides thereof.

FIG. 8 shows another construction of a modular system in accordance with the invention in the form of a cart. The cart includes modules 10A, 10B, 10C, 10D are arranged back-to-back with modules 10E, 10F, 10G, 10H respectively. The back sides of the modules may be secured together with double-sided adhesive tape, hook-and-loop fasteners adhered to the respective back surfaces, etc., as discussed hereinabove. Wheels 52 are provided with male or female connecting members 16, 18 and are mounted to the male and female connecting members 16, 18 on the lower long sides 12*a*, 12*b* of modules 10A and 10E. Module 10A is provided with doors 54 pivotally attached to the front edges of the short sides 14*a*, 14*b* of the module 10A. Module 10B is provided with magazine holders 56. Modules 10C and 10D are provided with a horizontal shelf 58 and module 10D is also provided with two drawers 60. Modules 10E–10H may include similar or different components.

The modular system in FIG. 8 also includes a backless file holder 62 which is attached to the connecting members 16, 18 on the short sides 14*a* of modules 10D and 10H. File holder 62 is thus an example of an accessory which is attached to multiple modules. A bar 64 is likewise provided on the opposite short sides 14*b* of modules 10D and 10H. Other types of accessories can also be designed to engage with two different modules.

FIG. 8 also shows a desk or table top 66 which includes male and/or female connecting members 16, 18 on an underside and is attached by these connecting members 16, 18 to the cooperating male and/or female connecting members 16, 18 on the upper long side 12*a* of the modules 10D and 10H. Table top 66 may include additional table top section hinged to one or more of its lateral edges and a support for supporting the hinged table top sections to create a larger surface area. The table top 66, with its connecting members 16, 18 (not shown) also stabilizes the cart structure and reinforces the back-to-back connection of the modules. File holder 62 and bar 64 also provide reinforcement and improve the structural integrity of the cart.

Figure 9:
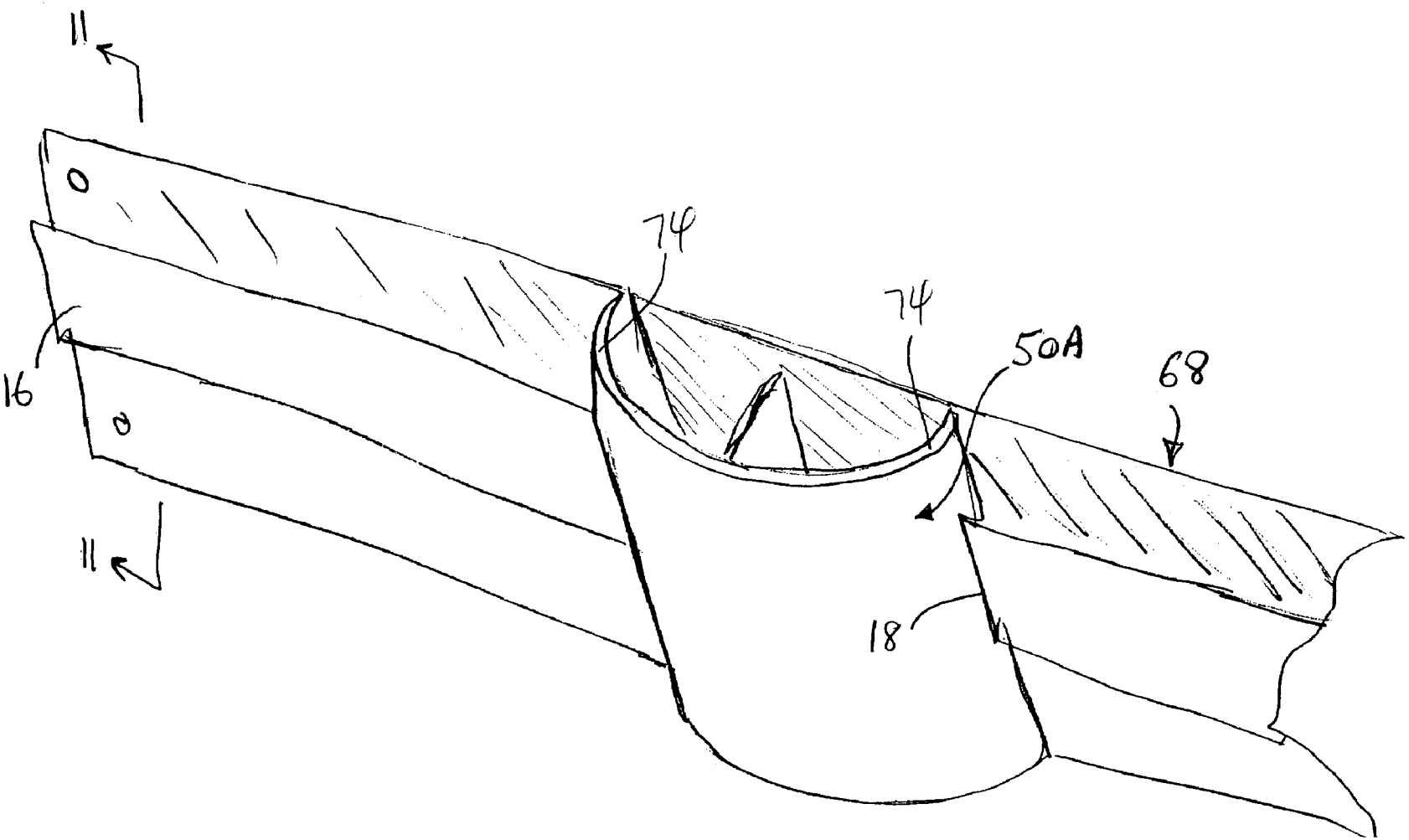
FIG. 9 shows a pencil case accessory mounted to a mounting strip.

Once accessories are provided with a male or female connecting members 16, 18, it becomes possible to use wall mountable strips 68, such as shown in FIG. 9, with similar connecting members (a male connecting member 16 being provided on the strip 68) to use the accessories apart from in combination with modules 10.

As shown in FIGS. 9 and 10, the pencil holder 50A is constructed to include female connecting members 18 on the inner end surfaces of defining walls 74. The female connecting members 18 are then engaged with the male connecting member 16 on the strip 68, which is attached to the wall.

Figure 11:
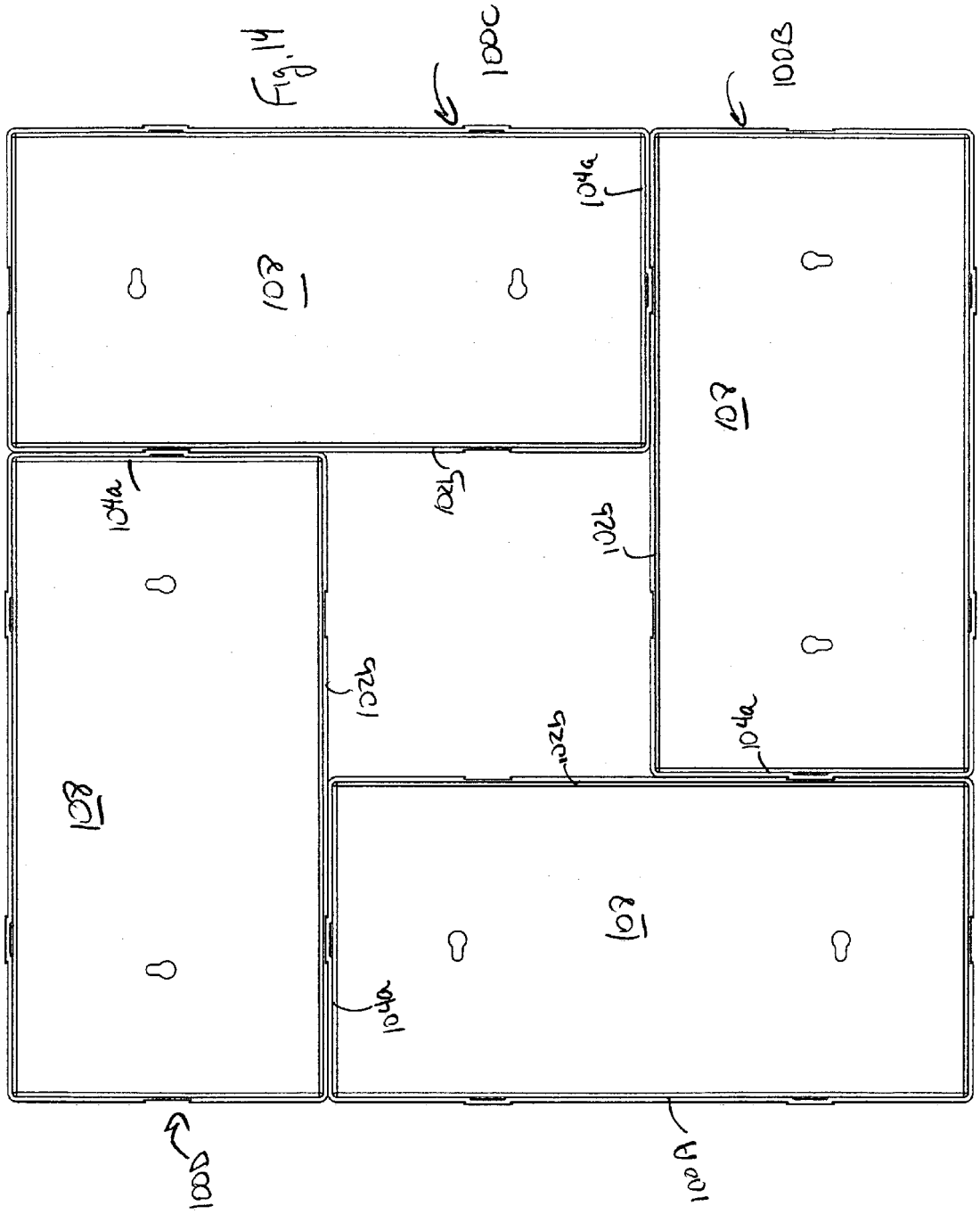
FIG. 11 is a sectional view on line 11—11 in FIG. 9, showing the mounting strip for the accessories, and showing hook-and-loop fasteners on a rear surface thereof for mounting to a wall.

Strip 68 is attached to a wall or other planar surface (such as a surface of furniture or other structure) by suitable attachment mechanisms such as screws 72 extending through apertures in the strip 68, adhesives, double-sided adhesive tape, hook-and-loop fasteners 74 and the like (see FIGS. 11 and 12). The strip 68 could also be constructed as shown in FIG. 12 as only a male connecting member with the screw holes formed therein.

An advantage of the use of a strip 68 is that accessories can be mounted wherever a wall or vertical surface is present, including in open office environments.

Figure 13:
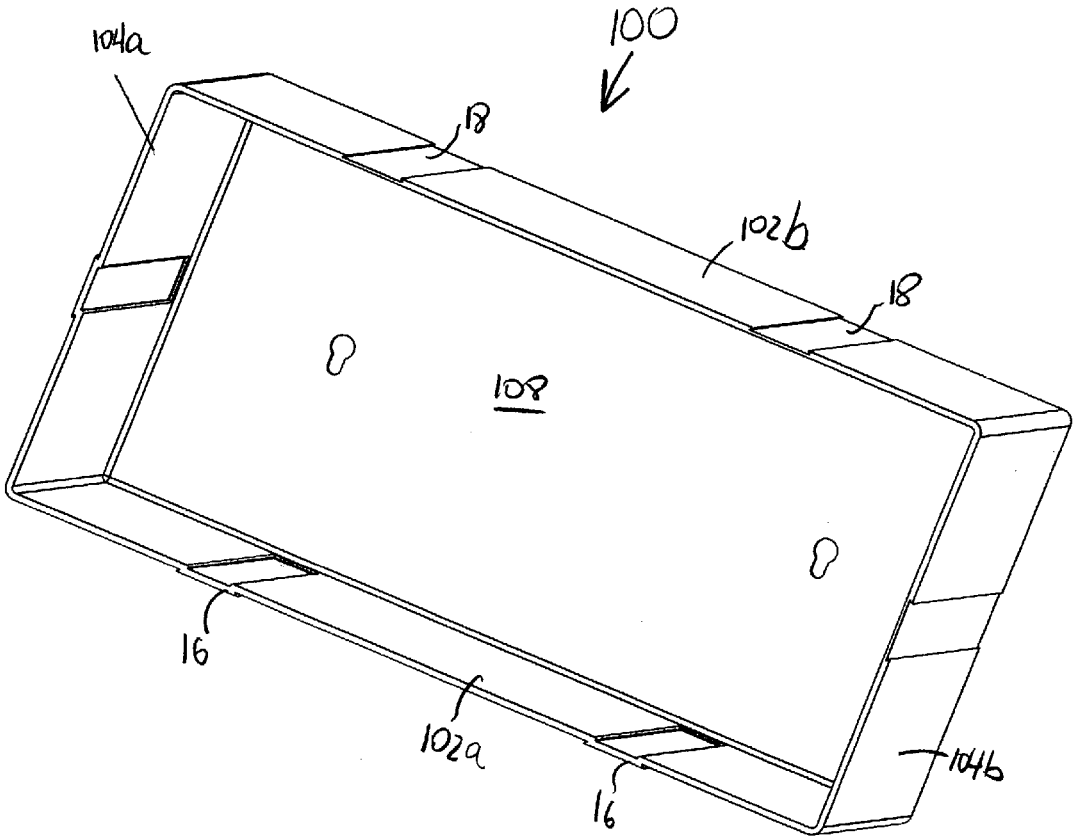
FIG. 13 is a perspective view of another embodiment of a module in accordance with the invention.
Figure 15:
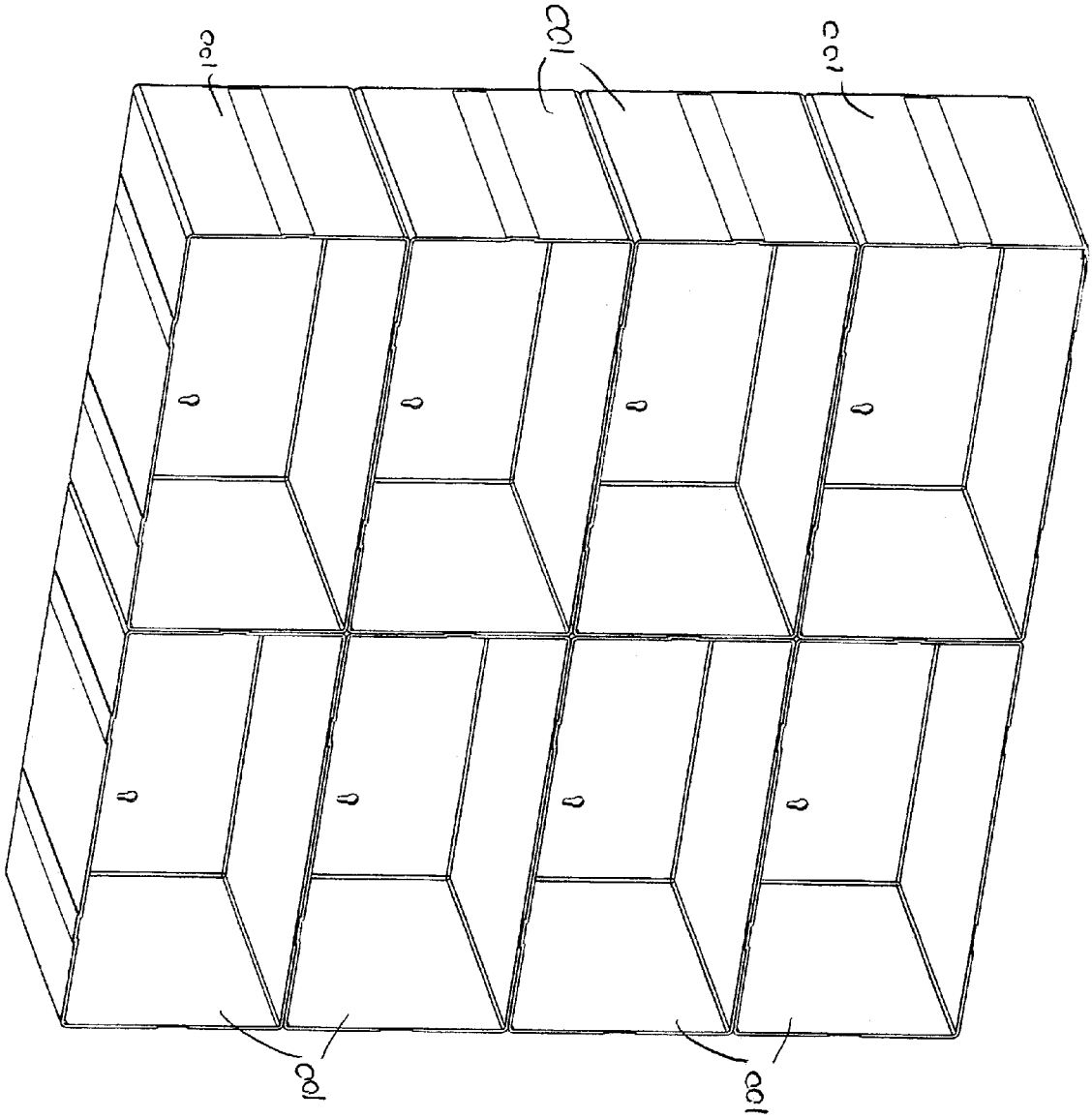
FIG. 15 is a perspective view of an assembly of eight modules of the type shown in FIG. 13.

Referring now to FIGS. 13–15, a second embodiment of a module in accordance with the invention is designated generally as 100. The module 100 differs from module 10 in that each long side 102*a*, 102*b* does not include one of each type of connecting member but rather, long side 102*a* includes two male connecting members 16 and long side 102*b* includes two female connecting members 18. As such, each male connecting member 16 on the long side 102*a* is opposite a female connecting member 18 on the long side 102*b*. Also, the male connecting members 16 not only project from the outer surface of the sides 102*a*, 104*a* of the module 100 but also define an indentation 106 in the inner surface.

The module 100 may be dimensioned the same as module 10 disclosed above (i.e., L1 is preferably twice L2, or even three time L2). The module 100 may include the same features as module 10 disclosed above and can be connected to other modules 100 in the same manner. For example, four modules 100A, 100B, 100C, 100D can be connected together as shown in FIG. 14 by engaging the female connecting members 18 on the long side 102*b* of one module 100A with a male connecting member 16 on the short side 104*a* of another module 100B, engaging the male connecting member 16 on the short side 104*a* of another module 100C with a female connecting member 18 on the long side 102*b* of the module 100B and engaging the male connecting member 16 on the short side 104*a* of another module 100D with a female connecting member 18 on the long side 102*b* of the module 100C while the female connecting member 18 on the long side 102*b* of module 100D is engaged with the male connecting member 16 on the short side of module 100A.

An optional square module can also be provided to be inserted into the middle of the system shown in FIG. 14 which would be similar to the module shown in FIG. 4. However, the square module would include male connecting members 16 on opposite sides walls and female connecting members 18 on the other opposite sides.

The modules 100 can use the same or similar accessories as disclosed above with respect to FIGS. 7–12, with the male-female connections being appropriately arranged for proper interconnection.

A plurality of modules 100 can be stacked one on top of the other as shown in FIG. 15 and connected to another stack via the cooperating the male and female connecting members 16, 18. This configuration can then be mounted to a wall, via the apertures in the rear panels 108 of the modules 100.

In both the modular systems shown in FIGS. 14 and 15, accessories, such as desk accessories and the like, which include male and/or female connecting members on an exposed surface can be connected to the modules 100. Some accessories are shown in FIGS. 7 and 8.

The modules, accessories, shelves, mounting strips and other parts used in the system of the present invention are preferably injection molded of moldable plastics materials such as, for example, styrene, high impact styrene, ABS, polypropylene and high density polyethylene.

It should be clear that various modifications and alterations can be made within the scope of the present invention. Also, various features of one embodiment can be combined with features of other embodiments, consistent with proper operation thereof, within the scope of the present invention.

I claim:

1. A modular storage and/or display system, comprising:

a plurality of modules, each of said modules including opposed first and second sides, each of said first and second sides having front and rear edges and lateral edges, opposed third and fourth sides, each of said third and fourth sides having front and rear edges and lateral edges, said third and fourth sides being perpendicular to said first and second sides and said lateral edges of said third and fourth sides being coupled to said lateral edges of said first and second sides to thereby provide said module with a rectangular shape, a male connecting member provided on an outer surface of each of said first and third sides, a female connecting member provided on an outer surface of each of said second and fourth sides, said female connecting member having a structure complementary to said male connecting member, and only a single additional male or female connecting member provided on each of said first and second sides such that each of said first and second sides includes only two connecting members, said single additional connecting member provided on said first side being a female connecting member and said single additional connecting member provided on said second side being a male connecting member, said two connecting members on each of said first and second sides being spaced apart from one another by a portion of said outer surface of said first or second side, each of said third and fourth sides including only one connecting member, said male and female connecting members being arranged on said first, second, third and fourth sides such that said male and female connecting members follow one another around the periphery of said module in an alternating manner whereby said male connecting member on said third side is not adjacent to said male connecting members on said first and second sides and said female connecting member on said fourth side is not adjacent to said female connecting members on said first and second sides, each of said modules being connectable to any other of said modules by coupling one of said male and female connecting members on said module to an opposite one of said male and female connecting members on the other one of said modules to thereby enable the formation of various configurations of said modules.

2. The system of claim 1, wherein said male connecting members are arranged on said first and second sides opposite one another and said female connecting members are arranged on said first and second sides opposite one another.

3. The system of claim 1, wherein a length of said first and second sides is defined between said lateral edges of said first and second sides and a length of said third and fourth sides is defined between said lateral edges of said third and fourth sides, said male and female connecting members on each of said first and second sides are each centered at a location about 25% of the length of said first and second sides from a respective one of said lateral edges of said first and second sides and said male and said female connecting members on said third and fourth sides are centered between said lateral edges of said third and fourth sides.

4. The system of claim 1, wherein said connecting members are dovetails.

5. The system of claim 1, further comprising positioning means arranged on an inner surface of said first and second sides or on an inner surface of said third and fourth sides for enabling placement of a shelf or partition in a space defined by said first, second, third and fourth sides.

6. The system of claim 5, wherein said positioning means comprise elongated projections.

7. The system of claim 1, wherein said male and female connecting members are parallel to said lateral edges of said first, second, third and fourth sides.

8. The system of claim 1, further comprising a square module engageable with each of said modules, said square module including opposed first and second sides, opposed third and fourth sides perpendicular and connected to said first and second sides, a single male connecting member provided on each of said first and second sides and identical to said male connecting members of said plurality of modules, and a single female connecting member provided on each of said third and fourth sides and identical to said female connecting members of said plurality of modules.

9. The system of claim 1, wherein said modules further comprise a rear wall connected to said rear edges of said first, second, third and fourth sides.

10. The system of claim 9, wherein said rear wall of each of said modules includes attachment means for attaching said module to a substrate and to a rear wall of another one of said modules.

11. The system of claim 1, further comprising a drawer insertable into an opening defined by said front edges of said first, second, third and fourth sides.

12. The system of claim 1, further comprising an accessory having a male or female connecting member on an outer surface identical to said male and female connecting members of said modules such that said accessory is engageable with said modules.

13. The system of claim 12, wherein said accessory is selected from a group consisting of a book-end, a file organizer, a file holder and a pencil holder.

14. The system of claim 1, further comprising wheel assemblies including a wheel and a supporting member having an outer surface and a male or female connecting member on said outer surface identical to said male and female connecting members of said modules such that said wheel assemblies are engageable with said modules to thereby form a cart.

15. The system of claim 1, further comprising a table top having a lower surface and at least one male or female connecting member on said lower surface identical to said male and female connecting members of said modules such that said table top is engageable with said modules to thereby form a desk.

16. The system of claim 1, wherein at least one of said modules further comprises at least one door hinged to a respective one of said first, second, third and fourth sides for closing an opening defined by said first, second, third and fourth sides of said module.

17. The system of claim 1, wherein said male and female connecting members are positioned on said modules such that when said first or second side of a first one of said modules is engaged via cooperating male and female connecting members to said third or fourth side of a second one of said modules, said third or fourth side of said first module is flush with said first or second side of said second module.

18. The system of claim 1, wherein a length of said first and second sides defined between said lateral edges of said first and second sides is a whole number multiple (N) of a length of said third and fourth sides defined between said lateral edges of said third and fourth sides.

19. The system of claim 18, wherein each of said male and female connecting members on said third and fourth sides is arranged such that when in engagement with an opposite one of said male and female connecting members on said first and second sides of another one of said modules, said third and fourth sides adjoin only a portion (1/N) of said first and second sides.

20. The system of claim 1, wherein said male connecting members project from said outer surface of said first and third sides and define an indentation in an inner surface of said first and third sides.

21. A modular storage and/or display system, comprising:

a plurality of modules, each of said modules including a plurality of sides having opposed lateral edges and being connected to one another at said lateral edges to thereby define an interior space, said plurality of sides including a first side, a second side and at least one additional side, said first and second sides being opposed to one another, each of said first and second sides having front and rear edges, said at least one additional side including opposed third and fourth sides, each of said third and fourth sides having front and rear edges, said third and fourth sides being perpendicular to said first and second sides and said lateral edges of said third and fourth sides being coupled to said lateral edges of said first and second sides to thereby provide said module with a rectangular shape, a single male connecting member projecting from a substantially planar outer surface of said first side and parallel to said lateral edges of said first side, said single male connecting member being centered between lateral edges of said first side with portions of said planar outer surface extending from said single male connecting member to both of said lateral edges, a single female connecting member formed in a substantially planar outer surface of said second side and parallel to said lateral edges of said second side, said female connecting member having a structure complementary to said male connecting member, said single female connecting member being centered between lateral edges of said second side with portions of said planar outer surface extending from said single female connecting member to both of said lateral edges, each of said third and fourth sides of said module including a male connecting member and a female connecting member, said male and female connecting members being arranged on said first, second, third and fourth sides such that said male and female connecting members follow one another around the periphery of said module in an alternating manner whereby said male connecting member on said first side is not adjacent to said male connecting members on said third and fourth sides and said female connecting member on said second side is not adjacent to said female connecting members on said third and fourth sides, each of said modules being connectable to any other of said modules by coupling one of said male and female connecting members on said module to an opposite one of said male and female connecting members on the other one of said modules to thereby enable the formation of various configurations of said modules.

22. The system of claim 21, wherein said male connecting members are arranged on said third and fourth sides opposite one another and said female connecting members are arranged on said third and fourth sides opposite one another.

23. The system of claim 21, wherein said male and female connecting members on each of said third and fourth sides are each centered at a location about 25% of a length of said third and fourth sides defined between said lateral edges of said third and fourth sides from a respective one of said lateral edges of said third and fourth sides.

24. The system of claim 21, wherein a length of said third and fourth sides defined between said lateral edges of said third and fourth sides is twice a length of said first and second sides defined between said lateral edges of said first and second sides.

25. The system of claim 21, further comprising positioning means arranged on an inner surface of opposed one of said sides for enabling placement of a shelf or partition in said space.

26. The system of claim 21, wherein said modules further comprise a rear wall connected to rear edges of said sides and including attachment means for attaching said module to a substrate and to a rear wall of another one of said modules.

* * * * *